US005208130A

United States Patent [19]

Almog et al.

[11] Patent Number: 5,208,130

[45] Date of Patent: May 4, 1993

[54] CHARGE DIRECTOR COMPOSITIONS FOR LIQUID DEVELOPER

[75] Inventors: Yaacov Almog, Rehovot; Frida Avadik, Rishon Le Zion, both of Israel

[73] Assignee: Spectrum Sciences B.V., Wassenaar, Netherlands

[21] Appl. No.: 533,765

[22] Filed: Jun. 6, 1990

Related U.S. Application Data

[63] Continuation-in-part of Ser. No. 387,161, Jul. 31, 1989, abandoned.

[51] Int. Cl.[5] ..... G03G 9/00

[52] U.S. Cl. ..... 430/115

[58] Field of Search ..... 430/115

[56] References Cited

U.S. PATENT DOCUMENTS

| | | | |
|---|---|---|---|
| 3,441,537 | 4/1969 | Lengnick . | |
| 3,729,419 | 4/1973 | Honjo et al. . | |
| 3,841,893 | 10/1974 | Honjo et al. . | |
| 4,469,881 | 9/1984 | Arkles . | |
| 4,746,751 | 5/1988 | Oviatt, Jr. et al. . | |
| 4,860,924 | 8/1989 | Simms et al. | 355/256 |
| 4,891,286 | 1/1990 | Gibson | 430/115 X |
| 4,902,570 | 2/1990 | Heinemann et al. . | |
| 5,045,425 | 9/1991 | Swidler | 430/115 |
| 5,066,821 | 11/1991 | Houle et al. . | |

FOREIGN PATENT DOCUMENTS

| | | |
|---|---|---|
| 2111985 | 9/1971 | Fed. Rep. of Germany . |
| 3209416 | 9/1983 | Fed. Rep. of Germany . |
| 55-83057 | 6/1980 | Japan . |
| 58-194070 | 11/1983 | Japan . |
| 61-176937 | 8/1986 | Japan . |
| 63-300241 | 12/1988 | Japan . |
| 8705128 | 8/1987 | World Int. Prop. O. . |

*Primary Examiner*—Marion E. McCamish
*Assistant Examiner*—Stephen C. Crossman
*Attorney, Agent, or Firm*—Sandler, Greenblum & Bernstein

[57] ABSTRACT

A liquid developer system for use in electrostatic imaging processes of the positive toner type comprises toner particles micro-dispersed in a carrier liquid and at least one charge director compound soluble in the carrier liquid, wherein the total amount of charge director compound is associated with the toner particles and essentially no charge director compound is present in the carrier liquid. Especially useful charge director compounds are those which have been reacted with at least about one molar equivalent of at least one acid containing at least one organic moiety, the acid being effective in that the reacted positive charge director compound increases the short-term charging of the micro-dispersed toner particles as compared with charging when the same molar amount of unreacted charge director compound is used. Positive charge director compounds reacted with acid are e.g. those of the general formula $RSiX_3$ wherein R is a hydrocarbon radical, one or more of the hydrogen atoms of which may be substituted by halogen atomsoms, and X is halogen or lower alkoxy; the reaction products with acid of the compounds $RSiX_3$ are believed to be novel.

46 Claims, No Drawings

CHARGE DIRECTOR COMPOSITIONS FOR LIQUID DEVELOPER

RELATED APPLICATION

This application is a continuation in part of U.S. patent application Ser. No. 387,161 filed Jul. 31, 1989, now abandoned, entitled IMPROVED CHARGE DIRECTOR COMPOSITIONS FOR LIQUID DEVELOPERS.

FIELD OF THE INVENTION

This invention relates to the field of electrostatic imaging and, more particularly, to improved charge director compositions for use therein and to liquid developer systems comprising such improved charge directors.

BACKGROUND OF THE INVENTION

In the art of electrostatic photocopying or photoprinting, a latent electrostatic image is generally produced by first providing a photoconductive imaging surface with a uniform electrostatic charge, e.g. by exposing the imaging surface to a charge corona. The uniform electrostatic charge is then selectively discharged by exposing it to a modulated beam of light corresponding, e.g., to an optical image of an original to be copied, thereby forming an electrostatic charge pattern on the photoconductive imaging surface, i.e. a latent electrostatic image. Depending on the nature of the photoconductive surface, the latent image may have either a positive charge (e.g. on a selenium photoconductor) or a negative charge (e.g. on a cadmium sulfide photoconductor). The latent electrostatic image can then be developed by applying to it oppositely charged pigmented toner particles, which adhere to the undischarged "print" portions of the photoconductive surface to form a toner image which is subsequently transferred by various techniques to a copy sheet (e.g. paper).

It will be understood that other methods may be employed to form an electrostatic image, such as, for example, providing a carrier with a dielectric surface and transferring a preformed electrostatic charge to the surface. The charge may be formed from an array of styluses. This invention will be described in respect of office copiers, though it is to be understood that it is applicable to other uses involving electrography such as electrostatic printing.

In liquid-developed electrostatic imaging, the toner particles are generally dispersed in an insulating non-polar liquid carrier, generally an aliphatic hydrocarbon fraction, which generally has a high-volume resistivity above about $10^9$ ohm cm, a dielectric constant below about 3.0 and a low vapor pressure (less than 10 torr. at 25° C.). The liquid developer system further comprises so-called charge directors, i.e. compounds capable of imparting to the toner l particles an electrical charge of the desired polarity and uniform magnitude so that the particles may be electrophoretically deposited on the photoconductive surface to form a toner image.

In the course of the process, liquid developer is applied to and covers the entire photoconductive imaging surface. The charged toner particles in the liquid developer migrate to the oppositely-charged areas forming the "print" portions of the latent electrostatic image, thereby forming the toner image.

Charge director molecules play an important role in the above-described developing process in view of their function of controlling the polarity and magnitude of the charge on the toner particles. The choice of a particular charge director for use in a specific liquid developer system, will depend on a comparatively large number of physical characteristics of the charge director compound, inter alia its solubility in the carrier liquid, its chargeability, its high electric field tolerance, its release properties, its time stability, etc. These characteristics are important to achieve high quality imaging, particularly when a large number of impressions are to be produced.

A wide range of charge director compounds for use in liquid-developed electrostatic imaging are known from the prior art. Pertinent examples of charge director compounds are ionic compounds, particularly metal salts of fatty acids, metal salts of sulfosuccinates, metal salts of oxyphosphates, metal salts of alkylbenzene-sulphonic acid, metal salts of aromatic carboxylic acids or sulphonic acids, as well as zwitterionic and non-ionic compounds, such as polyoxyetheylated alkylamines, lecithin, polyvinylpyrrolidone, organic acid esters of polyvalent alcohols, etc.

Most of the above-mentioned prior art charge director compounds have been used, or proposed for use, in electrostatic imaging processes, wherein the toner particles in the liquid developer system are negatively charged so that they may be electrophoretically deposited on a positively charged latent electrostatic image. Processes of the opposite type, i.e. wherein a negatively charged latent electrostatic image is produced on the photoconductive imaging surface and is developed by positively charged toner particles suspended in a liquid developer, have been less extensively used in the past, but have recently gained renewed interest. These processes will be referred to hereinafter as "positive toner processes". Such positive toner processes are described, for example, in copending U.S. patent application Ser. No. 400,715, filed Aug. 30, 1989 and entitled IMAGING ON PVC AND THE LIKE, the disclosure of which is incorporated herein by reference.

Alternatively, a positively charged photoconductor can be utilized with positive toner in a so-called reversal process, whereby the latent image is formed by removing charge from the image areas and the background areas remain charged. The development is performed with a positive developer electrode and the toner image is formed on the discharged image areas.

One of the problems encountered in such positive toner electrostatic imaging processes concerns the charge director compounds to be used in these processes. Among the wide range of prior art charge director compounds, none has yet been found which would yield fully satisfactory results when used in these positive toner processes. The main drawbacks of the charge director compounds hitherto proposed for "positive toner" processes, are the instability with time of the bulk charge of the toner particles and of the copy quality produced with liquid developer systems comprising these prior art charge director compounds. A further drawback of the prior art charge director compounds in such positive toner processes is their sensitivity to the nature of the pigments contained in the toner particles.

U.S. Pat. Nos. 3,729,419 and 3,841,893 disclosed the use of three specific organo-silicon compounds, namely vinyltriethoxysilane, gamma-glycidoxypropyltrimethoxysilane and beta-(3,4-epoxycyclohexyl)ethyltrimethoxysilane, for use as charge directors in liquid developers including those of the "positive toner" type. However, these charge director compounds must be employed at the comparatively very high concentrations of 0.5 to 2.0% by volume in the liquid developer.

It is therefore an object of the present invention to provide charge director compounds having improved properties, particularly as regards time stability of the toner charge and copy quality, for use in liquid developed electrostatic imaging processes of the above-mentioned positive toner type.

It is another object of the present invention to provide a liquid developer system comprising the above-mentioned improved charge director compounds for use in electrostatic imaging of the positive toner type. Yet other objects of the invention will be apparent from the description which follows.

SUMMARY OF THE INVENTION

It has been found in accordance with one aspect of the present invention that organo-silicon compounds of the general formula $RSiX_3$ (I), wherein R is a saturated hydrocarbon radical where one or more hydrogen atoms is optionally substituted by one or more halogen atoms, or is a hydrocarbon radical where one or more hydrogen atoms is substituted by one or more halogen atoms, and X is a halogen atom or a lower alkoxy radical, are most suitable for use as charge director compounds in liquid-developed electrostatic imaging processes of the positive toner type. Thus, liquid developer systems comprising the aforesaid organo-silicon compounds as charge directors, attain the above-mentioned objects of the invention, namely the toner particles in such liquid developers exhibit excellent time stability of charge, high mobility and very good copy quality which is also stable for relatively long periods of time. Furthermore, these charge director compounds utilized according to the present invention are relatively insensitive to the nature of the pigments included in the toner particles.

It has further been found in accordance with another aspect of the present invention, that in place of the compounds of formula $RSiX_3$, there may be utilized positive charge directors (such as at least one compound of formula (I) where R and X are as defined above), which charge directors have been reacted with at least about one molar equivalent of at least one acid containing at least one organic moiety, the acid being effective in that the reacted positive charge director compound increases the short-term charging of the micro-dispersed toner particles as compared with charging when the same molar amount of unreacted charge director compound is used. Such increased charging rate may be evidenced, for example by a comparative increase in the short-term mobility or conductance of the system.

Such reaction products appear to have all the desirable characteristics of the positive charge directors of formula (I), and the added advantages of more stable mobility and enhanced conductivity, and require less time to reach equilibrium, whereas the compounds of formula (I) do require a longer time to reach equilibrium, before use.

Accordingly, the present invention provides a liquid developer system for use in electrostatic imaging processes of the positive toner type, such system comprising:

an insulating non polar carrier liquid having a volume resistivity above about 109 ohm-cm and a dielectric constant below about 3.0;

toner particles micro-dispersed in said carrier liquid; and at least one charge director compound selected from sub groups (a) and (b), namely, (a) organo-silicon compounds of the general formula $RSiX_3$ (I), wherein R is a saturated hydrocarbon radical where one or more hydrogen atoms is optionally substituted by one or more halogen atoms, or is a hydrocarbon radical where one or more hydrogen atoms is substituted by one or more halogen atoms, and X is a halogen atom or a lower alkoxy radical; and (b) positive charge directors (such as at least one compound of formula (I) where R and X are as defined above), which have been reacted with at least about one molar equivalent of at least one acid containing at least one organic moiety, the acid being effective in that the reaction product increases at least the short-term charging of the positive charge director, as set forth above.

The present invention moreover provides an electrostatic imaging process of the positive toner type, comprising the steps of:

forming a negatively charged latent electrostatic image on a photoconductive surface;

applying to said surface positively charged toner particles from a liquid developer system according to the present invention, thereby to form a toner image on said surface; and transferring the resulting toner image to a substrate.

DETAILED DESCRIPTION OF THE INVENTION

In the organo-silicon charge directors utilized in accordance with the present invention, i.e. those of both sub-groups (a) and (b), as described above, R may be for example in one embodiment an alkyl group of 1 to 12 carbon atoms. In another embodiment, R is a saturated hydrocarbon radical where one or more hydrogen atoms is substituted by one or more halogen atoms, e.g. fluorine atoms. More particularly, R may be e.g. a mono- or polyhaloalkyl group of 1 to 12 carbon atoms, such as a group of 1 to 6 carbon atoms (exemplified by the 3,3,3-trifluoropropyl radical), or a mono- or polyhaloalkyl group of 7 to 12 carbon atoms (exemplified by the the 1H, 1H, 2H, 2H-perfluorooctyl radical). X may be illustratively chlorine or methoxy.

In the sub-group (b) charge directors, the at least one acid may be selected from, e.g., phosphorus-containing acids of formula $(R')_2P(:O)OH$ and sulfonic acids of formula $R''SO_3H$, where R' and R'' are each organic moieties and in the case of the phosphorus-containing acids the moieties R' may be the same as or different from each other. By way of example only, R' may be illustratively alkoxy such as butoxy or 2-ethylhexoxy, and the acid of formula $R''SO_3H$ may be illustratively an aliphatic sulfonic acid such as sulfosuccinic acid bis(2-ethylhexyl) ester $BuEtCHCH_2OOCCH(SO_3H)—CH_2COOCH_2CHEtBu$ or an alkylarylsulfonic acid such as the acid of which the sodium salt (MW 415–430) is marketed under the trade name Petronate L (Witco). Preferably, the at least one acid contains in total 8–32 carbon atoms.

It may be remarked that the acids preferably utilized to react with the compounds of formula (I), such as those exemplified in the preceding paragraph, are not themselves charge directors. Moreover, while the present invention in respect of the utilization of the organo-silicon charge directors of sub-group (b) is not restricted by any theory, nevertheless it is presently believed that in the reaction products in question, between 1 and 3× radicals of the compounds of formula (I) may be replaced by the corresponding acid radicals. This belief is supported by a noticeable change in the infrared spectra of compounds (I) when reacted with the acids in question.

Insofar as it is believed that the reaction products in question comprise or constitute new compositions of matter, the present invention includes in a particular aspect, substances selected from reaction products of an organosilicon compound of formula $RSiX_3$ with an acid of formula $(R')_2P(:O)OH$ or $R''SO_3H$, wherein R is a saturated hydrocarbon radical where one or more hydrogen atoms is optionally substituted by one or more halogen atoms, X is a halogen atom or a lower alkoxy radical, R' and R'' are each organic moieties and in the case of the phosphorus-containing acid the moieties R' may be the same as or different from each other, and mixtures of such reaction products. These reaction products may, e.g., contain per molecule 8–32 carbon atoms. Thus, more particularly, the reaction products may have a formula $RSi(X_m)\{O(O:)P(R')_2\}_n$ or $RSi(X_m)\{O_3SR''\}_n$, where m is 0, 1 or 2, n is 1, 2 or 3, and $m+n=3$.

In these reaction products including those believed to have the foregoing formulae, R may be for example in one embodiment an alkyl group of 1 to 12 carbon atoms. In another embodiment, R is a saturated hydrocarbon radical where one or more hydrogen atoms is substituted by one or more halogen atoms, e.g. fluorine atoms. More particularly, R may be e.g. a mono- or polyhaloalkyl group of 1 to 12 carbon atoms, such as such a group of 1 to 6 carbon atoms (exemplified by the 3,3,3-trifluoropropyl radical), or a mono- or polyhaloalkyl group of 7 to 12 carbon atoms (exemplified by the 1H, 1H, 2H, 2H-perfluorooctyl radical), and X may be for example chlorine or methoxy. Exemplary values for R' and R'' have been stated above.

The organo-silicon charge director compounds utilized according to the present invention, those defined under sub-groups (a) and (b), above, are soluble in the insulating non-polar liquid carriers of the liquid developer systems generally used in electrostatic imaging processes, as described above. To prepare the liquid developer systems utilized according to the invention, the charge director compounds can be added as such to the insulating non-polar liquid carrier or to the suspension of toner particles in such carrier. It is, however, more preferable in practice to add to the aforesaid carrier (or suspension of toner particles in the carrier) a stock solution of the organo-silicon charge director compound in a suitable non-polar organic solvent, preferably the same solvent which is used as the liquid carrier in the liquid developer system.

As stated above, the insulating non-polar liquid carrier, which should preferably also serve as the solvent for the charge director compounds utilized according to the invention, is most suitably an aliphatic hydrocarbon fraction having suitable electrical and other physical properties. Preferred solvents are the series of branched-chain aliphatic hydrocarbons and mixtures thereof, e.g. the isoparaffinic hydrocarbon fractions having a boiling range above about 155° C., which are commercially available under the name Isopar (a trademark of the Exxon Corporation).

The organo-silicon charge director compounds utilized in accordance with the present invention were found to be effective at relatively very small proportions with respect to the amount of toner employed. Preferably, the charge director compounds are used at proportions of 0.025–3% by weight, preferably 0.2–1% by weight based on the weight of the toner particles in the liquid developer system. Since the concentration of toner particles in the liquid developer systems usually ranges from 1–2% by weight, it follows that the effective concentrations of the charge director compounds utilized according to the invention in the liquid developer system would be from about 2.5 ppm to about 600 ppm, preferably from about 20 to about 200 ppm by weight of the total developer material. These suggested proportions of charge director (with respect to the amount of any particular toner) are not intended to be limitative of the scope of the invention, since on the one hand it will be within the ability of a person skilled in the art to determine the effective optimum proportion of charge director which may be used, and on the other hand the charge directors which may be utilized in accordance with the invention vary greatly in effectiveness. Illustratively, for example, it is shown in Table 10 below that the order of mobility of charge directors in respect of a particular toner is: (i) acid-reacted (1H, 1H, 2H, 2H-perfluorooctyl)trichlorosilane has a greater mobility than (ii) unreacted (1H, 1H, 2H, 2H-perfluorooctyl)trichloro silane which has a greater mobility than (iii) acid-reacted (3,3,3-trifluoropropyl)trichlorosilane which has a greater mobility than iv) unreacted (3,3,3-trifluoropropyl) trichlorosilane, when these are used in concentrations (mg./g toner) of 0.05, 0.2, 2 and 2, respectively.

As will be appreciated by persons skilled in the art, especially in light of the illustration at the end of the preceding paragraph, it is not the case that all acid-reacted charge directors in accordance with the invention have necessarily an increased mobility or conductance compared with all non-acid-reacted charge directors utilized in accordance with the invention, but rather that a particular acid-reacted charge director will have an increased mobility or conductance compared with the particular non-reacted charge director from which it is derived. Thus, the above illustration shows that the order of mobility is (i)>(ii) and (iii)>(iv), but on the other hand the mobility of (ii), a non-reacted charge director, is greater than (iii), an acid-reacted charge director derived from a different charge director starting material.

The fact that the organo-silicon charge director compounds utilized according to the present invention are effective at the comparatively very low concentrations mentioned above, may be explained by the following, surprising experimental finding made by the inventors (and reported in detail in Examples 16 and 17 hereinbelow). When a liquid developer system according to the invention comprising 1.5% by weight of toner microparticles in Isopar liquid carrier, and further comprising 2 mg of an organo-silicon charge director utilized according to the invention per 1 g of toner solids (0.2% by weight), was submitted to centrifugation in order to separate the suspended toner particles from the Isopar L solvent, the bulk conductivity of the supernatant liquid carrier was found to be practically zero. Upon redispersion of the sediment (i.e. the toner particles) in an equal volume of fresh liquid carrier (Isopar L), the bulk conductivity of the suspension reverted to the original value of the starting liquid developer system. The same result was observed after each of six repeated centrifugations and reconstitutions of the suspension with fresh portions of carrier liquid, and the conductivity of the suspension continued to revert substantially to the previous value.

It might be concluded from the above results that the electrical charge in the above-described liquid developer system is located substantially exclusively on the toner particles. It might further be concluded that practically the entire effective amount of organo-silicon charge director compound in the liquid developer system becomes associated with the toner particles, virtually irreversibly, and is thus separated together with the toner particles from the supernatant solvent in the course of the centrifugation, getting re-introduced, together with the toner particles, into the system upon resuspension in the fresh carrier liquid. Confirmation of this conclusion has been found from IR spectroscopy of the supernatant which shows a virtual absence of the charge director compounds of the invention, for the cases tested, as described more fully in examples 16 and 17.

The above discussed phenomenon of association of the charge director compounds utilized according to the invention with the toner particles is not merely of theoretical interest, but is probably also responsible for the following important practical advantage of the charge director compounds. This is the possibility of replenishing the charge director compound in the liquid developer system together with the toner particles which are being replenished, i.e. in the same make-up concentrate, as explained in the following.

The application of liquid developer to the photoconductive surface clearly depletes the overall amount of liquid developer in the reservoir of an electrocopying or electroprinting machine. However, the toner particles and the carrier liquid in the liquid developer system are not, as a rule, depleted at the same rate, because the total amounts of carrier liquid and toner particles utilized per electrocopy vary as a function of the proportional area of the printed portions of the latent image on the photoconductive surface. Thus, the greater the proportion of printed area of an original, the greater would be the relative depletion of toner particles in the liquid developer reservoir, as compared to the depletion of the carrier liquid. Therefore, in order to maintain in the liquid developer in the reservoir a relatively constant concentration of toner particles in carrier liquid, it is the practice to replenish the reservoir continuously, as necessary, by the separate additions of carrier liquid and of a concentrated dispersion of toner particles, from two separate sources. The amount of charge director in the liquid developer reservoir must also be replenished, since the charge director is also depleted together with the carrier liquid and the toner particles, at different rates.

In existing liquid-developed electrostatic imaging machines, the charge director is replenished by adding it either with the carrier liquid replenishment or with the concentrated toner dispersion. This results in charge director imbalance in the liquid developer system which may cause impairment of the quality of the copies. This problem does not arise with the charge director compounds utilized according to the present invention since, as explained above, the total amount of charge developer is associated with the toner particles in the liquid developer system and is, therefore, depleted at the same relative rate as the toner particles. It follows that constant desired concentrations of toner particles and charge director compound in the liquid developer system can be maintained by simultaneous replenishment, as necessary, of toner particles and charge director compound from a single source providing a concentrated dispersion of toner particles associated with the desired proportion of charge director compound in the carrier liquid.

The invention will be further described by the following, non-limiting examples, all of which relate to liquid developer systems and methods of the positive toner type. It should be understood that the invention is not limited to the specific toners nor to the specific carrier liquids exemplified herein, but rather extends to all modifications falling within the scope of the claims.

EXAMPLE 1

(A) Pigment-resin Compounding (black toner)

10 parts by weight of Elvax II 5720 (E.I. du Pont), and 5 parts by weight of Isopar L (Exxon) are mixed at low speed in a jacketed double planetary mixer connected to an oil heating unit, for 1 hour, the heating unit being set at 130° C.

A mixture of 1.875 parts by weight of Elftex 12 carbon black (Cabot), 0.125 parts by weight of nigrosin (basifying agent) and 4 parts by weight of Isopar L is then added to the mix in the double planetary mixer and the resultant mixture is further mixed for 1 hour at high speed. 20 parts by weight of Isopar L preheated to 110° C. are added to the mixer and mixing is continued at high speed for 1 hour. The heating unit is then disconnected and mixing is continued until the temperature of the mixture drops to 40° C. The mixture, diluted with ISOPAR L to a solids content of 12.5%, is then transferred to a Sweco vibratory device equipped with 0.5 in. cylindrical alumina media and ground for 24 hours with water cooling. The final median diameter is 2.7 microns.

(B) Preparation of liquid developer

The pigment-resin toner concentrate obtained by the procedure described under (A) above, was diluted with Isopar L to a concentration of 1.5% solids by weight and (3,3,3-trifluoropropyl)trichlorosilane (sometimes referred to herein as charge director compound I) was added to the resulting suspension in an amount corresponding to 3 mg per 1 g of pigment-resin solids material. The resulting mixture was left to equilibrate for 24 hours.

A Savin 870 electrocopier modified to allow for varying process voltages was charged with the above prepared liquid developer and operated in a reversal mode, i.e. in accordance with the positive toner type process. Different sets of copies on two different substrates were taken after various periods, starting from the time at which the liquid developer was charged to the machine. The copy quality parameters as measured using a Macbeth type TR 927 Reflection densitometer, are summarized in the following Table 1:

TABLE 1

| Time (days) | Substrate (paper) | Solid Area Density (SAD) |
|---|---|---|
| 1 | Savin 2200+ | 1.42 ± 0.11 |
| 6 | Savin 2200+ | 1.39 ± 0.10 |
| 27 | Savin 2200+ | 1.46 ± 0.07 |
| 1 | Printers Stock | 1.74 ± 0.03 |

TABLE 1-continued

| Time (days) | Substrate (paper) | Solid Area Density (SAD) |
|---|---|---|
| 6 | Printers Stock | 1.75 ± 0.03 |
| 27 | Printers Stock | 1.75 ± 0.03 |

The above results show a very good copy quality with both substrates, the copy quality remaining constant over a prolonged period of time.

EXAMPLE 2 in Compounding (black toner)

Pigment-resin material was prepared exactly as described in Example 1(A) above, except that before the mixture was diluted to achieve the final liquid developer, 10% by weight of solids of ground silicone gel to toner solids was added to the mixture.

The ground silicone gel was prepared by mixing 50 g of Dow Corning SYL-OFF 7600, 5 g of Dow Corning SYL-OFF 7601 and 1045 g of Isopar H in a glass beaker with a mechanical stirrer. SYL-OFF 7600 contains a platinum catalyst; SYL-OFF 7601 contains an inhibitor of polymerization. The mixture was heated to a temperature of about 94° C., with stirring for ½ hour during which time gelation occurred. The gel was allowed to cool to room temperature to form a 5% gel. The gel was ground for 6 hours in an S-1 attritor with 3/16 stainless steel balls. The viscosity of the ground gel decreased with time from about 5000 centipoise to about 160 centipoise and fine particles were obtained.

(B) Preparation of liquid developer

The procedure of Example 1(B) was followed using the material prepared in accordance with step (A) above, except that the (3,3,3-trifluoropropyl)trichlorosilane was used in an amount corresponding to 2 mg per 1 g of toner solids.

The liquid developer obtained was tested for copy quality in the same manner as described in Example 1 above (on Printers Stock substrate only) and the results are summarized in the following Table 2:

TABLE 2

| Time (days) | Substrate (paper) | Solid Area Density (SAD) | Transfer Efficiency (T.E.) |
|---|---|---|---|
| 1 | Printers Stock | 1.74 ± 0.08 | 94.6% |
| 52 | Printers Stock | 1.75 ± 0.05 | 95.5% |
| 79 | Printers Stock | 1.76 ± 0.04 | 95.6% |

The above results show excellent copy quality parameters which remain practically constant over a very long period of time (79 days).

EXAMPLE 3

(A) Pigment-resin Compounding (yellow toner)

300 g of a mixture consisting of Elvax II 5720 (du Pont), 3.5% by weight of yellow pigment Sicomet D 1350 and 0.5% by weight of aluminium stearate was comelted with 700 g of Isopar L at 100° C. until a homogeneous blend was obtained. The blend was allowed to cool to room temperature. The resulting material was diluted to 12.5 solids concentration and was transferred to a Dyno Mill and ground for 2 hours, yielding particles with a final average particle size of 1.9 microns.

B) Preparation of liquid developer

The pigment-resin material prepared as described above, was diluted to 1.5% of NVS (non volatile solids) in Isopar L and (3,3,3-trifluoropropyl)trichlorosilane was added to the suspension in an amount corresponding to 2 mg per 1 g of toner solids. The mixture was equilibrated for 24 hours and tested in a modified Savin 870 copier as described in Example 1(B). The copy quality parameters as measured using a Macbeth type TR 927 Reflection densitometer with a blue filter, on two substrates are summarized in the following Table 3:

TABLE 3

| Time (days) | Substrate (paper) | Solid Area Density (SAD) | Transfer Efficiency (T.E.) |
|---|---|---|---|
| 1 | Savin 2200+ | 0.85 ± 0.04 | 93.4% |
| 29 | Savin 2200+ | 0.90 ± 0.03 | 97.8% |
| 1 | Printers Stock | 0.99 ± 0.02 | 98.0 |
| 29 | Printers Stock | 1.01 ± 0.02 | 98.0 |

EXAMPLE 4

(A) Preparation of toner concentrate (cyan toner)

25 g of Elvax II 5720 (du Pont), 3.9 g of Monasteral blue BT583-d (HEUBACH), 0.6 g of Bontron P-51 (Orient Chemicals) and 70 g of Isopar L were co-melted at 100° C. until a homogeneous blend was obtained. The blend was allowed to cool to room temperature and transferred to a small attritor to which an additional 100 g Isopar L were added. After 20 hours of grinding there was obtained a dispersion, the particles of which had a median diameter of 1.3 microns.

(B) Preparation of liquid developer

The concentrate prepared under (A) above was suspended in Isopar L at a dilution of 1.5% by weight of solids. (3,3,3-Trifluoropropyl)trichlorosilane was added to the suspension in an amount corresponding to 1 mg per 1 g of toner solids and the mixture was left to equilibrate for 10 hours. The liquid developer thus obtained was tested in a modified Savin 870 copier as described in Example 1. The results as measured using a Macbeth type TR 927 Reflection densitometer with a red filter, are summarized in the following Table 4:

TABLE 4

| Substrate (paper) | Solid Area Density (SAD) | Transfer Efficiency (T.E.) |
|---|---|---|
| Savin 2200+ | 1.41 ± 0.04 | 89.2% |
| Printers Stock | 1.49 ± 0.03 | 91.4% |

EXAMPLE 5

(A) Preparation of toner concentrate (magenta toner)

30 g of a mixture of 93% by weight of Elvax II 5950 (DuPont), 3.5% by weight of pigment RV 6832 (DuPont), 2.5% by weight of pigment R 6300 (DuPont) and 1% by weight of aluminium stearate was comelted with 70 g of Isopar L at 100° C. until a homogeneous blend was obtained. The blend was allowed to cool to room temperature and transferred to a small attritor, together with an additional 100 g of Isopar L. The mixture was ground using stainless steel balls for 17 hours yielding a concentrate with an average particle size of 1.9 microns.

(B) Preparation of liquid developer

The concentrate prepared under (A) above was suspended in Isopar L at a concentration of 1.5% by weight of solids and (3,3,3-trifluoropropyl)trichlorosilane was added to the mixture in an amount corresponding to 4 mg per 1 g of toner solids. The mixture was allowed to equilibrate for 24 hours and tested as described in Example 1 on printers Stock copy sheet. The solid area density of the prints was 0.75±0.03 and the transfer efficiency—99% (measured with a Macbeth type TR 927 Reflection densitometer using a green filter).

EXAMPLE 6

The pigment-resin material as prepared in Example 1(A) was used to prepare a liquid developer by the procedure described in Example 1(B), except that (3,3,3-trifluoropropyl)trimethoxysilane was used instead of (3,3,3-trifluoropropyl)trichlorosilane at the same proportion, i.e. 3 mg of silane per 1 g of toner solids and that the mixture was allowed to equilibrate for 3 days rather than 24 hours.

The liquid developer obtained was tested in a modified Savin 870 copier as described in Example 1(B) and the results are summarized in the following Table 5:

TABLE 5

| Time (days) | Substrate (paper) | Solid Area Density (SAD) | Transfer Efficiency (T.E.) |
|---|---|---|---|
| 3 | Savin 2200+ | 1.62 | 88.3% |
| 10 | Savin 2200+ | 1.67 | 93.2% |
| 3 | Printers Stock | 1.66 | 93.2% |
| 10 | Printers Stock | 1.64 | 95.9% |

EXAMPLE 7

(A) Pigment-resin Compounding 10 parts by weight of Elvax II 5720 (du Pont), and 5 parts by weight of Isopar L (Exxon) are mixed at low speed in a jacketed double planetary mixer connected to an oil heating unit set at 130° C., for 1 hour. A mixture of 2.5 parts by weight of Mogul L carbon black (Cabot) and 5 parts by weight of Isopar L is then added to the mix in the double planetary mixer and the resultant mixture is further mixed for 1 hour at high speed. 20 parts by weight of Isopar L preheated to 110° C. are added to the mixer and mixing is continued at high speed for 1 hour. The heating unit is then disconnected and mixing is continued until the temperature of the mixture drops to 40° C. The mixture diluted with ISOPAR L to a solids content of 12.5% was then transferred to a Sweco vibratory device equipped with 0.5 in. alumina media and ground for 24 hours with water cooling.

(B) Preparation of liquid developer

The pigment-resin material concentrate obtained by the procedure described under (A) above, was diluted with Isopar L to a concentration of 1.5% by weight and 0.5 mg of (3,3,3-trifluoropropyl)-trichlorosilane was added to the resulting suspension per gram of toner solids. The resulting mixture was left to equilibrate for a half hour.

The liquid developer thus obtained was tested in a modified Savin 870 copier as described in Example 1(B) and the results are summarized in the following Table 6:

TABLE 6

| Time (days) | Substrate (paper) | Solid Area Density (SAD) | Transfer Efficiency (T.E.) |
|---|---|---|---|
| 1 | Savin 2200+ | 1.15 ± 0.15 | 79.3% |

TABLE 6-continued

| Time (days) | Substrate (paper) | Solid Area Density (SAD) | Transfer Efficiency (T.E.) |
|---|---|---|---|
| 8 | Savin 2200+ | 1.30 ± 0.11 | (not tested) |
| 30 | Savin 2200+ | 0.82 ± 0.11 | 58.6% |
| 1 | Printers Stock | 1.75 ± 0.04 | 89.3% |
| 8 | Printers Stock | 1.01 ± 0.02 | (not tested) |
| 30 | Printers Stock | 0.76 ± 0.15 | 66.1% |

It is believed that the degradation with time of the process results is due to the acidic nature of the Mogul L carbon black. It is noted that when Elftex 12 which has a basic nature is substituted for the Mogul L, as for example in Example 1 above, the degradation does not occur.

EXAMPLE 8 (A) Preparation of a charged toner concentrate

The pigment-resin material prepared in Example 1(A) was suspended in Isopar L at a concentration of 12.5% by weight of solids and (3,3,3-trifluoropropyl)trichlorosilane was added to the suspension in an amount corresponding to 2 mg per g of toner solids. The system was allowed to equilibrate for 24 hours.

(B) Preparation of liquid developer

The charged toner concentrate prepared under (A) above, was diluted in Isopar L to a concentration of 1.5% by weight of solids and the liquid developer obtained was tested in a modified Savin 870 copier as described in Example 1(B). The copy quality parameters immediately after dilution are summarized in the following Table 7:

TABLE 7

| Substrate (paper) | Solid Area Density (SAD) | Transfer Efficiency (T.E.) |
|---|---|---|
| Savin 2200+ | 1.47 ± 0.05 | 89.6% |
| Printers Stock | 1.65 ± 0.03 | 94.8% |

EXAMPLE 9

(A) Preparation of toner concentrate

The procedure of Example 1(A) was repeated, except that Elvax II 5650 T (DuPont), a terpolymer of methacrylic acid, polyethylene and isobutyl methacrylate, was used instead of Elvax II 5720, a copolymer of polyethylene and methacrylic acid. The blend was attrited for 32 hours, and an average particle size of 1.8 microns was obtained.

(B) Preparation of liquid developer

The concentrate prepared under (A) above was suspended in Isopar L at a concentration of 1.5% by weight of solids and (3,3,3-trifluoropropyl)trichlorosilane was added in an amount corresponding to 2 mg per 1 g of solids. The resulting mixture was equilibrated for 15 hours. The liquid developer thus obtained was tested in a modified Savin 870 copier as described in Example 1 and the results are summarized in the following Table 8:

TABLE 8

| Time (days) | Substrate (paper) | Solid Area Density (SAD) | Transfer Efficiency (T.E.) |
|---|---|---|---|
| 1 | Savin 2200+ | 1.54 ± 0.02 | 92.8% |
| 24 | Savin 2200+ | 1.41 ± 0.07 | 92.8% |
| 1 | Printers Stock | 1.80 ± 0.03 | 95.7% |

TABLE 8-continued

| Time (days) | Substrate (paper) | Solid Area Density (SAD) | Transfer Efficiency (T.E.) |
|---|---|---|---|
| 24 | Printers Stock | 1.79 ± 0.02 | 97.3% |

EXAMPLE 10

(A) Preparation of toner concentrate 38.25 g of Elvax II 5720 (DuPont), 6.75 g of Elftex 12 (Cabot), 0.45 g of Aizen TP 302 (Hodogaya) and 70 g of Isopar L were comelted at 100° C. until a homogeneous blend was obtained. The blend was left to cool to room temperature and transferred to a small attritor for grinding in the presence of additional 100 g Isopar L. After 22 hours of grinding, a dispersion having a median particle diameter of 2.2 microns was obtained.

(B) Preparation of liquid developer

The toner concentrate prepared under (A) above was suspended in Isopar L at a concentration of 1.5% by weight of n.v.s. and (3-chloropropyl)trichlorosilane was added in an amount corresponding to 4 mg per 1 g of solids. The resulting mixture was left to equilibrate for 48 hours.

The liquid developer thus obtained was tested in a modified Savin 870 copier using Printers Stock paper. Copies had a solid area density (SAD) of 1.42±0.05.

EXAMPLE 11

(A) Preparation of toner concentrate

A mixture comprising the following ingredients was prepared:

| | |
|---|---|
| Elvax II 5650 T (DuPont) | 22.5 g |
| Macromelt 6239 (Henkel) | 2.5 g (a polyamide resin) |
| Elftex 12 (Cabot) | 6.25 g |
| Aizen TP 302 (Hodogaya) | 0.31 g |
| Isopar L | 12.5 g |

The above mixture was comelted at 170° C. and then diluted to a 12.5% solids concentration which as transferred to a small attritor provided with steel balls 3/16 inch in diameter. After grinding for about 48 hours a suspension having a median diameter of 2.12 microns was obtained.

(B) Preparation of liquid developer

The concentrate prepared under (A) above was suspended in Isopar L at a concentration of 1.5% by weight of solids. (3,3,3-trifluoropropyl)trichlorosilane was added in an amount corresponding to 2 mg per 1 g of solids. The liquid developer thus obtained was tested in a modified Savin 870 copier and the results are summarized in the following Table 9:

TABLE 9

| Substrate (paper) | Solid Area Density (SAD) | Transfer Efficiency (T.E.) |
|---|---|---|
| Savin 2200+ | 1.32 ± 0.06 | 84.1% |
| Printers Stock | 1.70 ± 0.05 | 91.4% |

EXAMPLE 12

The toner concentrate prepared in accordance with Example 11(A) above was suspended in Isopar L at a concentration of 1.5% by weight of solids. Isobutyltrichlorosilane was added in an amount corresponding to 2 mg per 1 g of toner solids. The liquid developer thus obtained was tested in a modified Savin 870 copier, whereupon copies of fair quality were obtained.

EXAMPLE 13

(A) Preparation of acid reaction product charge directors

(i) s utilized in the example

Acid A is Phosphoric acid bis(2-ethylhexyl) of formula $\{BuEtCHCH_2O\}_2P(O:)OH$.

Acid B is dibutyl ester, of formula $(BuO)_2P(O:)OH$. Both acid A and Acid B are commercially available products.

Acid C is Sulfosuccinic acid bis(2-ethylhexyl) ester of formula:

$$BuEtCHCH_2OOCCH(SO_3H)—CH_2COOCH_2.CHEtBu$$

which is prepared by exchanging the cation in the corresponding sodium salt (marketed under the trade name "Aerosol OT", Cyanamid) for hydrogen, by using an acidic cationic exchange resin.

In a preferred embodiment of the invention, Acid C is prepared by:

(a) washing 150 ml of Dowex 50WX8 (acid form; 16–40 mesh), available from Dow Chemical, with 100 ml of isopropanol, twice;

(b) Add a solution of 0.02 moles of Aerosol OT in 80 ml isopropanol to the washed exchange resin;

(c) stir for 80 minutes and filter through a paper filter (the filtrate is acidic (pH=0–0.5);

(d) dry the filtrate and dissolve in ISOPAR.

Acid D is the alkylarylsulfonic acid of which the sodium salt (MW 415–430) is marketed under the trade name Petronate L (Witco). It is prepared similarly to the preparation of Acid C.

(ii) Unreacted charge directors utilized in the example

Charge director I: is (3,3,3-trifluoropropyl) trichlorosilane.

Charge director II: is (1H, 1H, 1H, 2H, 2H-perfluorooctyl) trichlorosilane.

Both charge directors I and II are also per se charge directors of the invention.

(iii) Preparation of the acid reacted charge directors

To 1–10% w/w solutions of the compound $RSiX_3$ (X=Cl) (I and II), in Isopar H were added 1–3 molar equivalents of the acids specified in part (i), above. The mixture was allowed to equilibrate for at least one hour before use. The infrared spectra of the products in Isopar H solution were significantly different from that of unreacted charge directors I and II, showing that a chemical change had occurred.

B: Toners used in the example

Toner #1: is the toner based on Elvax II 5720 as prepared in Example 1, above.

Toner #2: is prepared as follows:

10 parts by weight of ELVAX 5650T (DuPont) and 5 parts by weight of Isopar L (Exxon) are mixed at low speed for one hour in a jacketed double planetary mixer connected to an oil heating unit, which was set at 130° C. A mixture of 1.875 parts by weight of Elftex 12 carbon black (Cabot), 0.125 parts by weight of nigrosin (basifying agent) and 4 parts by weight of Isopar L is then added to the mix in the double planetary mixer and the resultant mixture is further mixed for 1 hour at high speed. 20 parts by weight of Isopar L preheated to 110° C. are added to the mixer and mixing is continued at high speed for 1 hour.

The heating unit is then disconnected and mixing is continued until the temperature of the mixture drops to 40° C. The mixture was then transferred to a large attritor equipped with stainless steel 1/16 inch media and ground for 24 hours with water cooling. The final median diameter was 1.5 microns. The concentrated black imaging toner was diluted with Isopar H to a concentration of 1.5% by weight n.v.s. (non-volatile solids).

Toner #3: is prepared as follows:

(I) Composition of toner particles:

(1) 330 parts Bostik #7915 Polyester Polymer Resin (Bostik Chemical Group);

(2) 100 parts Bostik #4165 Hot Melt Adhesive (Bostik Chemical Group);

(3) 270 parts VYNS-3 copolymer of vinyl chloride/-vinyl acetate (Union Carbide);

(4) 100 parts Macromelt #6239 Polyamide (Henkel);

(5) 200 parts Elftex 12 Carbon Black (Cabot).

(6) 100 parts Vestowax SF 616 High Density Polyethylene Wax (Huls)

(II) Preparation of Liquid Developer:

(a) Components 1 and 2 are compounded together in a two roll mill at 130° C. until well mixed, approximately 5–10 minutes.

(b) The result of step (a) and component 3 are compounded together in a two roll mill at 130° C. until well mixed, approximately 5–10 minutes.

(c) The result of step (b) and component 4 are compounded together in a two roll mill at 130° C. until well mixed, approximately 5–10 minutes.

(d) The result of step (c) and component 5 are compounded together in a two roll mill at 130° C. until well mixed, approximately 5–10 minutes.

(e) The resultant material is cut into approximately 1 cm pieces, which are cooled to liquid nitrogen temperatures.

(f) The cooled pieces are cryogenically ground in a Retch Model ZM 1 grinder, using a 1.5 mm screen. This process yields a fine powder.

(g) 30 parts by weight of the powder is added to 70 parts by weight of Isopar L (Exxon) and the material is ground in an attritor (S-01 size manufactured by Union Process Inc.) with 3/16" carbon steel balls at approximately 30° C. for 64 hours.

(h) Component 6 is added to the attritor and grinding is continued for 8 additional hours.

(i) the toner particles are mixed with Isopar L to form a developer with 1.5% solids content, but Isopar L may be substituted by Isopar G or H, if a developer with a more volatile carrier is desired.

(C) Preparation of liquid toners

Liquid toners are prepared by charging toners #1, #2 and #3 with acid reacted and non-reacted charge directors I and II of the invention. The mobility and conductance of the resultant toners is given in Tables 10 to 12.

TABLE 10

| CHARGE DIRECTOR I reacted with 3 moles*: | MOBILITY (cm./sec/volt/micron) | | | | | | | | |
|---|---|---|---|---|---|---|---|---|---|
| | Toner #1♦ | | | Toner #2§ | | | Toner #3♦ | | |
| DAYS: | 0 | 1 | 4 | 0 | 1 | 4 | 0 | 1 | 5 |
| Acid C | 0.08 | 0.12 | 0.08 | | | | | | |
| Acid D | 0.11 | 0.12 | 0.13 | | | | | | |
| Acid B | 0.48 | 0.5 | 0.64 | | | | | | |
| Acid A (3 moles) | 0.48 | 0.52 | 0.68 | 0.53 | 0.6 | 0.5 | 0 | 0.37 | 0.36 |
| (1 mole) | | | | 0 | 0.08 | 0.09 | | | |
| " (6 moles) | | | | 0.8 | 0.82 | 0.98 | | | |
| " (9 moles) | | | | 0 | 0.08 | 0.5 | | | |
| CONTROL (I) | 0 | 0.08 | 0.53 | 0 | 0.07 | 0.22 | 0 | 0 | 0.13 |

*unless otherwise indicated

TABLE 11

| CHARGE DIRECTOR II reacted with 3 moles: | MOBILITY (cm./sec/volt/micron) | | | | | | | | |
|---|---|---|---|---|---|---|---|---|---|
| | Toner #1 | | | Toner #2 | | | Toner #3 | | |
| DAYS: | 0 | 1 | 4 | 0 | 1 | 4 | 0 | 1 | 5 |
| Acid A | | | | | | | 0.8 | 1.12 | 1.63 |
| CONTROL (II)♥ | | | | | | | 0 | 0.3 | 0.55 |

TABLE 12

| CHARGE DIRECTOR I reacted with: | CONDUCTANCE, phmos/cm. (Toner #2§) | | | | | |
|---|---|---|---|---|---|---|
| DAYS: | 0 | 1 | 2 | 4 | 7 | 11 |
| Acid A (3 moles) | 13.1 | 13.1 | 13.1 | 13.8 | 15.0 | 14.0 |
| " (1 mole) | 9.0 | 13.8 | 16.2 | 16.2 | 15.0 | 15.1 |
| " (6 moles) | 18.1 | 16.9 | 16.9 | 16.2 | 17.5 | 16.9 |
| " (9 moles) | 10.0 | 8.8 | 11.2 | 13.8 | — | — |
| CONTROL (I) | 0 | 8.1 | 12.0 | 12.7 | 12.6 | 11.9 |

NOTE TO TABLES 10 to 12:
(1) concentration of reaction products and controls in terms of mg. unreacted charge director per gram. of toner particles:
I: ♦2 mg.; §1 mg.;
II: ♥0.2 mg.; 0.05 mg.

EXAMPLE 14

The product of charge director I reacted with Acid A (on a 1:3 molar basis) was added to toner #2 to form a first liquid developer. Unreacted charge director I was added to toner #2 to form a second liquid developer. In both cases the amount of charge director added was based on 1 mg of unreacted charge director 1 per gram of toner solids.

The resulting developers were tested in a modified Savin 870 copier. Comparative results for printing quality parameters are shown in Table 13.

TABLE 13

| TIME (mins) | SUBSTRATE (paper) | SOLID AREA DENSITY (I) | SOLID AREA DENSITY (Reacted) | TRANSFER EFFICIENCY (I) | TRANSFER EFFICIENCY (Reacted) |
|---|---|---|---|---|---|
| 10 | {Savin 2200+ | 0.07 ± 0.01 | 1.10 ± 0.06 | — | 71.9 |
| | {Printers Stock | — | 1.58 ± 0.04 | — | 86.3 |
| 80 | {Savin 2200+ | 1.19 ± 0.1* | 1.38 ± 0.06 | too low | 77.5 |
| | {Printers Stock | 1.35 ± 0.12* | 1.69 ± 0.04 | — | 84.9 |
| 180 | {Savin 2200+ | 1.22 ± 0.08 | 1.49 ± 0.04 | 72.6 | 83.2 |
| | {Printers Stock | 1.53 ± 0.13 | 1.72 ± 0.05 | 83.6 | 91.0 |

*dirty background

EXAMPLE 15

The product of charge director II reacted with Acid A (on a 1:3 molar basis) was added to toner #2 to form a first liquid developer. Unreacted charge director II was added to toner #2 to form a second liquid developer. The amount of unreacted charge director used for the second liquid developer was 0.2 mg of charge director per gram of toner solids. The amount of reacted charge director used for the first liquid developer was based on 0.05 mg of unreacted charge director 1 per gram of toner solids.

The resulting developers were tested in a modified Savin 870 copier. Comparative results for printing quality parameters are shown in Table 14.

TABLE 14

| TIME | SUBSTRATE (paper) | SOLID AREA DENSITY (SAD) (II) | SOLID AREA DENSITY (SAD) (Reacted) | TRANSFER EFFICIENCY (T.E.) % (II) | TRANSFER EFFICIENCY (T.E.) % (Reacted) |
|---|---|---|---|---|---|
| 30 min. | Printers Stock | unreadable | 1.55 ± .04 | — | 97.5 |
| 1 day | Printers Stock | 1.20 ± 0.04 | 1.54 ± 0.02 | 87.6 | 99.4 |

EXAMPLE 16

The pigment-resin material prepared in Example 1(A) was suspended in Isopar L and (3,3,3-trifluoropropyl) trichlorosilane was added to the suspension in the amount corresponding to 2 mg per 1 g of solids. Two samples of 30 g each of the mixture thus obtained, were centrifuged at 10 krpm for 10 mins. The conductivity of the dispersion before the centrifugation and that of the supernatant obtained by the centrifugation, were measured. The supernatant was then decanted off and the sediment was redispersed in an equal amount of fresh Isopar L. The bulk conductivity was measured again and the process of centrifugation repeated. The results of six repeated centrifugations and redispersions of the sediment in fresh solvent are summarized in the following Table 15:

TABLE 15

| Cycle | Bulk Conductivity pmho/cm | Supernatant Conductivity pmho/cm | Conductivity of re-dispersed material pmho/cm |
|---|---|---|---|
| 1 | 13 (initial suspension) | 0 | 13 |
| 2 | 13 | 0 | 12 |
| 3 | 12 | 0 | 12 |
| 4 | 12 | 0 | 12 |
| 5 | 12 | 0 | 12 |
| 6 | 12 | 0 | 12 |

EXAMPLE 17

Toner #2 was charged with 1 mg/gm portion of charge director type I reacted with Acid A in a 1:3 molar ratio. Two samples of 30 g each of the mixture thus obtained, were centrifuged at 10 krpm for 10 minuites. The conductivity of the dispersion before the centrifugation and that of the supernatant obtained by the centrifugation, were measured. The supernatant was then decanted off and the sediment was redispersed in an equal amount of fresh Isopar L. The bulk conductivity was measured again and the process of centrifugation repeated. The results of five repeated centrifugations and redispersions of the sediment in fresh solvent are summarized in the following Table 16:

TABLE 16

| Cycle | Bulk Conductivity pmho/cm | Supernatant Conductivity pmho/cm | Conductivity of re-dispersed material pmho/cm |
|---|---|---|---|
| 1 | 16.9 (initial suspension) | 1.5 | 16.9 |
| 2 | 16.9 | 0 | 16.9 |
| 3 | 16.9 | 0 | 16 |
| 4 | 16 | 0 | 15 |
| 5 | 15 | 0 | 15 |

This experiment was repeated for charge director concentration of 0.5 mg/gm. For this charge director level, initial conductivity was 8 pmho/cm. This conductivity did not change after centrifugation and redilution. The conductivity of the supernatant was too small to be measured (i.e., 0) for all cycles. The results were similar for a charge director level of 0.25 mg/gm, with initial conductivity of 6 pmho/cm.

It should be noted that solutions in ISOPAR of the charge directors of the invention as described in examples 16 and 17 do not have appreciable conductivity.

Measurements using IR spectroscopy showed no measurable amount of charge director compound in the supernatant for Example 16. IR measurement of the supernatant of the first centrifugation of Example 17 were not conclusive in establishing the presence or absence of charge director or in the determination of the cause of the conductivity in the supernatant. For subsequent centrifugations there was clearly no measurable amount of charge director in the supernatant.

The results described in Examples 16 and 17 show that at least up to up to a given concentration of charge director (the level varying with charge director and toner type), charge director is associated essentially only with the toner particles. For the tested charge directors, this concentration is suitable for liquid toners.

The behavior described in Examples 16 and 17 is different from the behavior of other known carrier liquid soluble charge directors. For the known charge directors, the solution of charge director in carrier liquid is conducting. For known charge directors, at concentrations suitable for use in liquid toner, there is a balance between the amount of the charge director associated with the toner particles and the amount dissolved in the carrier liquid. Thus when toner particles and carrier liquid are depleated from the liquid toner in the system at different rates during image formation, a separate closed loop charge control system is generally required.

It has been found that toners charged with at least some of the charge directors of the present invention are very stable with regard to their conductivity over a period of many months. This stability, coupled with the unusual toner particle affinity characteristics of the charge directors of the present invention allows for substantial simplification of liquid toner electro-printing systems.

Since all of the essential charge director is associated with the toner particles, the depletion of charge director during the printing process is proportional to the depletion of toner particles. Thus no separate system for maintaining the charge of the liquid toner in the system is needed, and charge director can be added as part of the toner concentrate, in which the particles are precharged by the charge director.

Separate measurements of toner particle and charge director concentration are not necessary. In known systems, the toner particle concentration is generally measured by measuring the optical density of the liquid toner and the charge level is measured by measuring the conductivity. For charge directors of the present invention, only one of these measurements need be made. Generally, the conductivity measurement is easier to make.

In summary, the special characteristics of the charge directors of the present invention allow for a liquid toner replenishment method which includes only measuring the conductivity of the liquid toner in the system, adding precharged toner particle concentrate to the liquid toner in response to that measurement, measuring the amount of liquid toner in the system and adding carrier liquid to the liquid toner in response to that measurement. No separate measurement of toner particle concentration or apparatus for adding charge director is needed.

It will be appreciated by persons skilled in the art that the present invention is not limited by what has been particularly shown and described hereinabove. Rather the scope of the present invention is defined only by the claims which follow:

We claim:

1. A liquid developer for use in electrostatic imaging processes of the positive toner type, such system comprising:

an insulating non polar carrier liquid;

toner particles micro-dispersed in said carrier liquid; and at least one charge director compound selected from the group consisting of sub-groups (i) and (ii), namely:

(i) organo-silicon compounds of the general formula $RSiX_3$ wherein

R is either a saturated hydrocarbon radical where one or more hydrogen atoms is optionally substituted by one or more halogen atoms or R is a hydrocarbon radical where one or more hydrogen atoms is substituted by one or more halogen atoms, and X is a halogen atom or a lower alkoxy radical; and (ii) the organo-silicon reaction product of at least one unreacted charge director compound of subgroup (i) with at least about one mole of at least one acid containing at least one organic moiety.

2. A liquid developer according to claim 1 wherein said at least one charge director compound is selected from sub-group (i).

3. A liquid developer according to claim 2, wherein said toner particles comprise at least one resin and at least one pigment.

4. A liquid developer according to claim 2, wherein said charge director compound is present at a concentration of from about 0.1 to about 3% by weight based on the weight of the toner particles.

5. A liquid developer according to claim 4 wherein said charge director compound is present at a concentration of from about 0.2 to about 1% by weight based on the weight of the toner particles.

6. A liquid developer according to claim 2 wherein said carrier liquid is a branched-chain aliphatic hydrocarbon or a mixture of such hydrocarbons.

7. A liquid developer according to claim 6 wherein said carrier liquid is an isoparaffinic hydrocarbon fraction having a boiling range above about 155 degrees C.

8. An electrostatic imaging process of the positive toner type, comprising the steps of:

forming a latent electrostatic image on a photoconductive surface;

applying to said surface positively charged toner particles from a liquid developer according to claim 2, thereby to form a toner image on said surface; and transferring the resulting toner image to a substrate.

9. A liquid developer according to claim 2, wherein X is a methoxy group.

10. A liquid developer according to claim 2, wherein X is chlorine.

11. A liquid developer according to claim 2, wherein R is an alkyl group of 1 to 6 carbon atoms.

12. A liquid developer according to claim 2, wherein R is the 3,3,3-trifluoropropyl radical.

13. A liquid developer according to claim 2, wherein R is a hydrocarbon radical substituted by one or more halogen atoms.

14. A liquid developer according to claim 2, wherein R is a saturated hydrocarbon radical where one or more hydrogen atoms is optionally substituted by one or more halogen atoms.

15. A liquid developer according to claim 2 wherein R is a hydrocarbon radical where one or more hydrogen atoms is substituted by one or more fluorine atoms.

16. A liquid developer according to claim 2, wherein R is a saturated hydrocarbon radical substituted by one or more fluorine atoms.

17. A liquid developer according to claim 2, wherein R is a saturated hydrocarbon radical.

18. A liquid developer according to claim 2, wherein R is a saturated hydrocarbon radical having one or more hydrogen atoms substituted by one or more halogen atoms.

19. A liquid developer according to claim 2, wherein R is a alkyl group of 7 to 12 carbon atoms.

20. A liquid developer according to claim 2, wherein R is the 1H, 2H, 2H-perfluorooctyl radical.

21. A liquid developer according to claim 1 wherein said at least one charge director compound is selected from sub-group (ii).

22. A liquid developer according to claim 21, wherein said toner particles comprise at least one resin and at least one pigment.

23. A liquid developer according to claim 21 wherein said charge director compound is present at a concentration of from about 0.1 to about 3% by weight based on the weight of the toner particles.

24. A liquid developer according to claim 23 wherein said charge director compound is present at a concentration of from about 0.2 to about 1% by weight based on the weight of the toner particles.

25. A liquid developer according to claim 21 wherein said carrier liquid is a branched-chain aliphatic hydrocarbon or a mixture of such hydrocarbons.

26. A liquid developer according to claim 25 wherein said carrier liquid is an isoparaffinic hydrocarbon fraction having a boiling range above about 155 degrees C.

27. An electrostatic imaging process of the positive toner type, comprising the steps of:

forming a latent electrostatic image on a photoconductive surface;

applying to said surface positively charged toner particles from a liquid developer according to claim 21, thereby to form a toner image on said surface; and transferring the resulting toner image to a substrate.

28. A liquid developer according to claim 21 wherein X is chlorine.

29. A liquid developer according to claim 21 wherein R is an alkyl group of 1 to 6 carbon atoms.

30. A liquid developer according to claim 21 wherein R is the 3,3,3-trifluoropropyl radical.

31. A liquid developer according to claim 21, wherein R is a hydrocarbon radical substituted by one or more halogen atoms.

32. A liquid developer according to claim 21, wherein R is a saturated hydrocarbon radical where one or more hydrogen atoms is optionally substituted by one or more halogen atoms.

33. A liquid developer according to claim 21 wherein R is a hydrocarbon radical where one or more hydrogen atoms is substituted by one or more fluorine atoms.

34. A liquid developer according to claim 21 wherein R is a saturated hydrocarbon radical substituted by one or more fluorine atoms.

35. A liquid developer according to claim 21 wherein R is a saturated hydrogen radical having one or more hydrogen atoms substituted by one or more halogen atoms.

36. A liquid developer according to claim 21, wherein R is a alkyl group of 7 to 12 carbon atoms.

37. A liquid developer according to claim 21, wherein R is the 1H, 1H, 2H, 2H-perfluorooctyl radical.

38. A liquid developer for use in electrostatic imaging processes of the positive toner type, such system comprising:

an insulating non polar carrier liquid;

toner particles micro-dispersed in said carrier liquid; and at least one positive charge director compound which has been reacted with at least about one molar equivalent of at least one acid containing at least one organic moiety, said acid being effective in that said reacted positive charge director compound increases the short-term charging of said micro-dispersed toner particles as compared with said charging when the same molar amount of unreacted charge director compound is used, wherein said unreacted positive charge director compound comprises at least one compound of the general formula (I)

$$RSiX_3 \qquad (I)$$

wherein

R is either a saturated hydrocarbon radical where one or more hydrogen atoms is optionally substituted by one or more halogen atoms or R is a hydrocarbon radical where one or more hydrogen atoms is substituted by one or more halogen atoms, and X is a halogen atom or a lower alkoxy radical.

39. A liquid developer according to claim 38, wherein said at least one acid (b) is selected from the group consisting of phosphorus-containing acids of formula $(R')_2P(:O)OH$ and sulfonic acids of formula $R''SO_3H$, where R' and R'' are each organic moieties and in the case of the phosphorus-containing acid the moieties R' may be the same as or different from each other.

40. A liquid developer according to claim 39, wherein the total number of carbon atoms in said at least one acid is within the range of 8–32 carbon atoms.

41. A liquid developer according to claim 39, wherein said reacted positive charge director compound comprises at least one compound selected from the group consisting of those of formulae:

$$RSi(X_m)\{O(O:)P(R')_2\}_n \text{ and } RSi(X_m)\{O_3SR''\}_n,$$

wherein

R is a hydrocarbon radical where one or more hydrogen atoms is substituted by one or more halogen atoms, X is a halogen atom or a lower alkoxy radical, m is less than 3, n is greater than 0 and $m+n=3$.

42. A liquid developer according to claim 39, wherein said reacted positive charge director compound comprises at least one compound selected from the group consisting of those of formulae:

$$RSi(X_m)\{O(O:)P(R')_2\}_n \text{ and } RSi(X_m)\{O_3SR''\}_n,$$

wherein

R is a saturated hydrocarbon radical where one or more hydrogen atoms is optionally substituted by one or more halogen atoms, X is a halogen atom or a lower alkoxy radical, m is less than 3, n is greater than 0 and $m+n=3$.

43. An electrostatic imaging process of the positive toner type, comprising the steps of:

forming a latent electrostatic image on a photoconductive surface;

applying to said surface positively charged toner particles from a liquid developer according to claim 38, thereby to form a toner image on said surface; and transferring the resulting toner image to a substrate.

44. An electrostatic imaging process according to claim 43, wherein said at least one acid is selected from the group consisting of phosphorus-containing acids of formula $(R')_2P(:O)OH$ and sulfonic acids of formula $R'SO_3H$, where R' and R'' are each organic moieties and in the case of the phosphorus-containing acid the moieties R' may be the same as or different from each other.

45. An electrostatic imaging process according to claim 44, wherein said reacted positive charge director compound comprises at least one compound selected from the group consisting of those of formulae:

$$RSi(X_m)\{O(O:)P(R')_2\}_n \text{ and } RSi(X_m)\{O_3SR''\}_n,$$

wherein

R is a hydrocarbon radical where one or more hydrogen atoms is substituted by one or more halogen atoms, X is a halogen atom or a lower alkoxy radical.

46. An electrostatic imaging process according to claim 44, wherein said reacted positive charge director compound comprises at least one compound selected from the group consisting of those of formulae:

$$RSi(X_m)\{O(O:)P(R')_2\}_n \text{ and } RSi(X_m)\{O_3SR''\}_n,$$

wherein

R is a saturated hydrocarbon radical where one or more hydrogen atoms is optionally substituted by one or more halogen atoms, and X is a halogen atom or a lower alkoxy radical, where m is less than 3, n is greater than 0 and $m+n=3$.

* * * * *